US005309651A

United States Patent [19]

Handel

[11] Patent Number: 5,309,651

[45] Date of Patent: May 10, 1994

[54] TRANSFORMABLE SHOE

[75] Inventor: David B. Handel, Margate, N.J.

[73] Assignee: Fabulous Feet Inc., Margate, N.J.

[21] Appl. No.: 754,275

[22] Filed: Sep. 9, 1991

Related U.S. Application Data

[63] Continuation-in-part of Ser. No. 706,245, May 28, 1991, abandoned.

[51] Int. Cl.[5] ..... A43B 21/433; A43B 21/42

[52] U.S. Cl. ..... 36/100; 36/34 R; 36/42; 36/97; 36/81

[58] Field of Search ..... 36/100, 34 R, 36 R, 36/36 A, 36 B, 36 C, 34 A, 39, 41, 42, 105, 97, 80, 81

[56] References Cited

U.S. PATENT DOCUMENTS

| | | | |
|---|---|---|---|
| 1,023,603 | 4/1912 | Wegmann-Eggmann | 36/61 |
| 1,047,716 | 12/1912 | Sperling | 36/61 |
| 2,258,265 | 10/1941 | Schwartz | 36/100 |
| 2,707,341 | 5/1955 | Romano | 36/100 |
| 2,836,907 | 6/1958 | Windle | 36/36 R |
| 3,464,126 | 9/1969 | Sarkissian | 36/100 |
| 3,805,418 | 4/1974 | Matuka et al. | 36/34 A |
| 3,879,864 | 4/1975 | Exley | 36/61 |
| 4,291,473 | 9/1981 | Sartor | 36/132 |
| 4,411,076 | 10/1983 | Wilkinson | 36/34 R |
| 4,416,072 | 11/1983 | Sarkissian | 36/100 |
| 4,910,885 | 3/1990 | Hsieh | 36/38 |

FOREIGN PATENT DOCUMENTS

| | | | |
|---|---|---|---|
| 28982 | 12/1904 | United Kingdom | 36/36 R |
| 406901 | 3/1934 | United Kingdom | 36/36 R |

*Primary Examiner*—Steven N. Meyers
*Attorney, Agent, or Firm*—Norman E. Lehrer

[57] ABSTRACT

Transformable shoe frames are described wherein the heel of the shoe can be extended downwardly in a high heel position or converted to a low heel position. The shoe frame is made in sections that are pivotally connected to each other and mechanisms have been provided to lock the sections together in varying positions, so that the angle between the toe portion and the remainder of the shoe can be adjusted to maximize the comfort of the wearer depending on whether the heel is in a high heel or a low heel position. Additional mechanisms are illustrated to change the contour of the arch when the heel height is changed. In a preferred embodiment the heel is stowable under the sole of the shoe and the sole will have a well defined flexible region in the distal metatarsal region of the shoe, either by having a hinged joint or built in flexibility.

13 Claims, 7 Drawing Sheets

TRANSFORMABLE SHOE

This application is a continuation-in-part of U.S. application Ser. No. 706,245 filed May 28, 1991 now abandoned.

This invention relates to a transformable shoe frame and heel. More particularly, this invention relates to mechanisms for shoes that enable them to easily and quickly convert from a high heel to a low heel configuration.

BACKGROUND OF THE INVENTION

Women have been entering the worlds of business and the professions in ever increasing numbers in recent years. This requires that they dress in a rather formal way, including the need for dress shoes. The term dress shoe includes a wide range of shoes, e.g., opera pumps to high fashion shoes. Dress shoes can have a wide range of heel heights and shapes, from a modest 2 inch heel to a 3–4 inch stiletto heel. The higher the heel, the more difficult the shoes are to walk in for extended periods and distances than flat heeled shoes, and they slow down the walker. Thus it has also become the norm for women to wear low heeled walking shoes, and even sneakers, to and from work, and to change shoes when they reach their places of business. This necessitates carrying dress shoes back and forth, or maintaining an extensive shoe wardrobe at the office.

Shoes that can convert from dress to walking shoes have been tried in the past, but have not become commercially successful. Schwartz in U.S. Pat. No. 2,258,265 discloses a shoe with a detachable heel. A fixed heel portion has a shank iron to which heels of varying height can be affixed. However, a wearer's foot inclines at various angles with respect to the ground depending on the height of the heel. No provision is made by Schwartz for changing the shape or inclination of the arch of the shoe depending on the heel height. Thus the wearer will not be comfortable at all potential heel heights.

Sarkissian in U.S. Pat. No. 3,464,126 discloses a shoe with an adjustable heel, but it is set far forward of the heel of the wearer, and has a bulky mechanism making the manufacture of high fashion shoes impossible.

Sarkissian in U.S. Pat. No. 4,416,072 discloses a shoe with an adjustable arch. The shoe is made in two sections and the heel height, which is adjustable, also changes the angle of the heel and arch with respect to the toe portion. However, there is no way to change the shape of the arch to maximize the wearer's comfort at varying heel heights.

The prior art shoes are bulky, and means of varying the heel height are cumbersome and inconvenient. Thus high fashion shoes cannot be made with a variable height heel using the concepts of the prior art. There is a need for shoes that allow instant changeover from a walking shoe to a high fashion shoe which has been unmet heretofore.

SUMMARY OF THE INVENTION

The shoe frames and heels of the present invention can be transformed from a walking shoe, having a low heel height, to a high fashion shoe having a higher heel height, conveniently and rapidly. A high heel that is stowable under the shoe is provided. Further, the frame optionally provides pivotal motion between the toe portion and the heel portion of the shoe frame. In addition, the shape of the arch portion of the shoe can be changed to increase the comfort of the wearer depending on the height of the heel chosen.

DETAILED DESCRIPTION OF THE INVENTION

The shoe frame as described hereinbelow is independent of the final appearance of the shoe which can vary according to the dictates of the fashion designer. The high strength shoe elements described herein are meant to be covered with standard liners, cushion materials, uppers, sole coverings and heel coverings, which can be made of various materials known to those skilled in the art such as leather, various man-made materials and resins, fabric and the like. The transformable heel can be made of metal or other high strength material, which will be covered with leather, plastic, fabric and the like, or can be made of wood or wood simulated material. The basic structure of the shoe frame of the invention is independent of the size, shape, type and materials which provide the final appearance of the shoe.

The shoe frame and heel of the invention will be further described by reference to the drawings.

Figure 1:
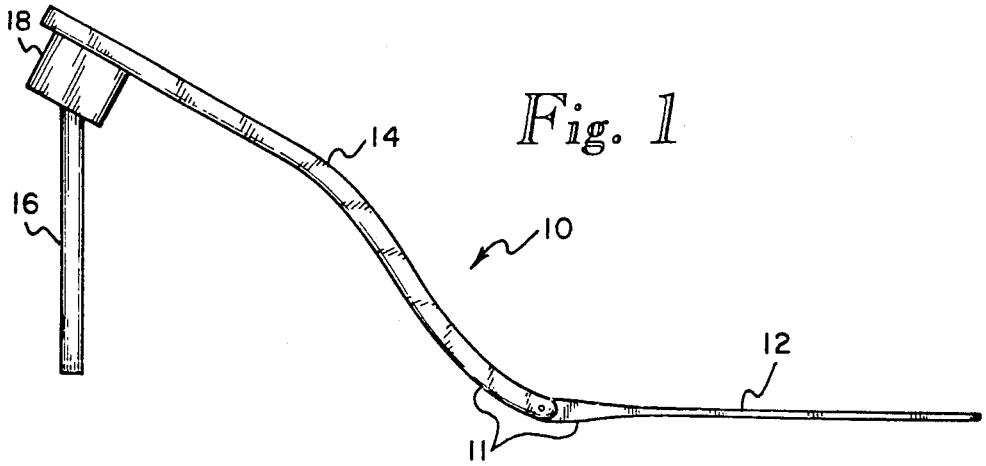
FIG. 1 is a cross sectional view of a two-part shoe frame of the invention illustrating an extended heel.

FIG. 1 is a cross sectional view of a shoe frame 10 having a two-part sole 11 comprising a toe portion 12 and a heel portion 14 pivotally connected thereto. A transformable heel 16 is shown with the heel 16 in an extended, or high heel, position.

Figure 1A:
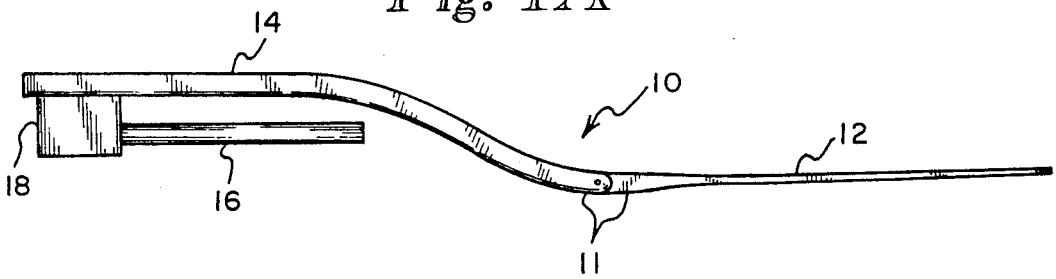
FIG. 1A is a cross sectional view of a two-part shoe frame of the invention illustrating a stowed heel.

FIG. 1A, wherein the same parts have identical numbers, shows the transformable heel 16 in a stowed, or low heel, position, wherein the upper heel section 18 is the low heel when the transformable heel section 16 is stowed.

The toe portion 12 of the shoe frame 10 must be made of a flexible material, such as leather or spring steel, so that, as the wearer walks, climbs stairs and the like, the toe portion 12 will accommodate to the natural changes in inclination of the toe to the rest of the foot of the wearer.

The toe portion 12 is pivotally attached to the heel portion 14, which is made of a more rigid material. The angle between the toe portion 12 and the heel portion 14 can be varied depending on whether the heel is in its fully extended or retracted or stowed position, i.e., whether the shoe frame 10 is in a high heel or a low heel configuration. The heel portion 14 has a gentle curve to ensure the comfort of the wearer. The sole portions can be locked in place as will be explained in greater detail hereinbelow.

Figure 2:
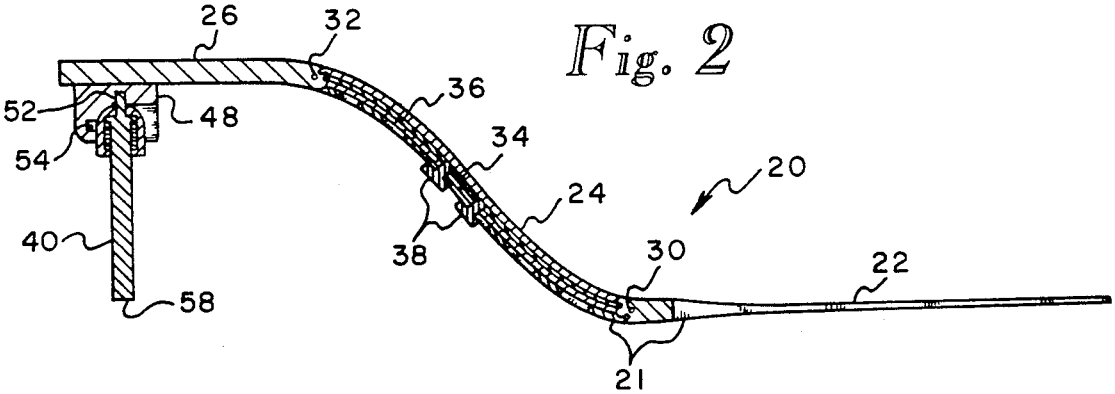
FIG. 2 is a cross sectional view of a three-part shoe frame of the invention illustrating an extended heel.
Figure 2A:
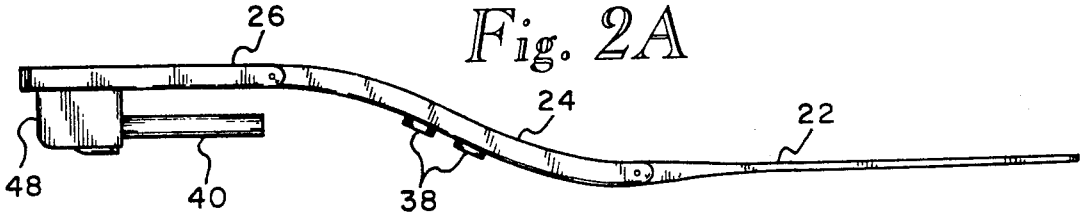
FIG. 2A is a cross sectional view of a three-part shoe frame of the invention illustrating a stowed heel.

FIG. 2 is a cross sectional view of a three-part shoe frame 20 of the invention having a three-part sole 21 comprising a flexible toe portion 22, an arch portion 24 and a heel portion 26 adjustably connected to the arch section 24. FIG. 2 illustrates the shoe frame 20 with the heel extended, i.e., in the high heel position, and FIG. 2A illustrates the shoe frame 20 with the heel in the stowed position, i.e., in the low heel position. This three-part shoe sole 21 allows for greater variation in the angle of the arch portion 24 with respect to the toe portion 22 and heel portion 26 respectively.

In the embodiment shown in FIG. 2, the three portions of the shoe are attached by means of pivotal hinges 30 and 32. The arch portion 24 has a spring 34 attached to a movable bar 36 and a slidable switch 38. This mechanism acts as a dead bolt to affix the hinge in various positions. Alternate means of securing the relative positions of the three sole portions 22, 24 and 26, will be further described hereinbelow. A transformable heel 40 is attached to the heel portion 26 of the sole 21.

In the following figures and description, the same numbering is used for like parts throughout for ease of explanation.

Figure 3B:
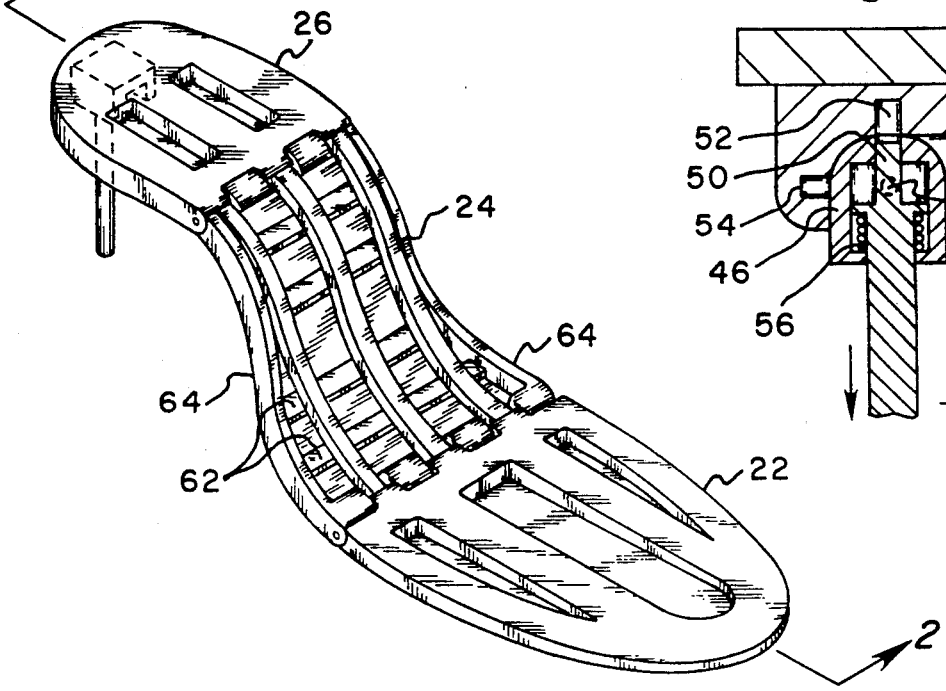
FIG. 3B is a perspective view of the frame and heel of FIG. 2.
Figure 3A:
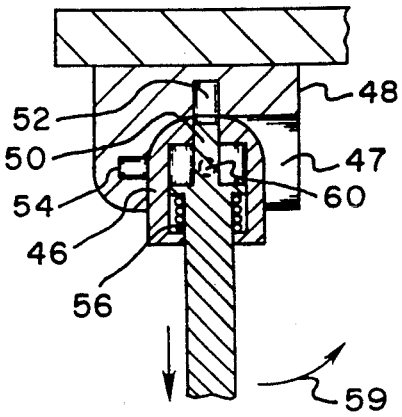
FIG. 3A is a more detailed view of the heel of FIG. 2 prior to stowing the heel.
Figure 3:
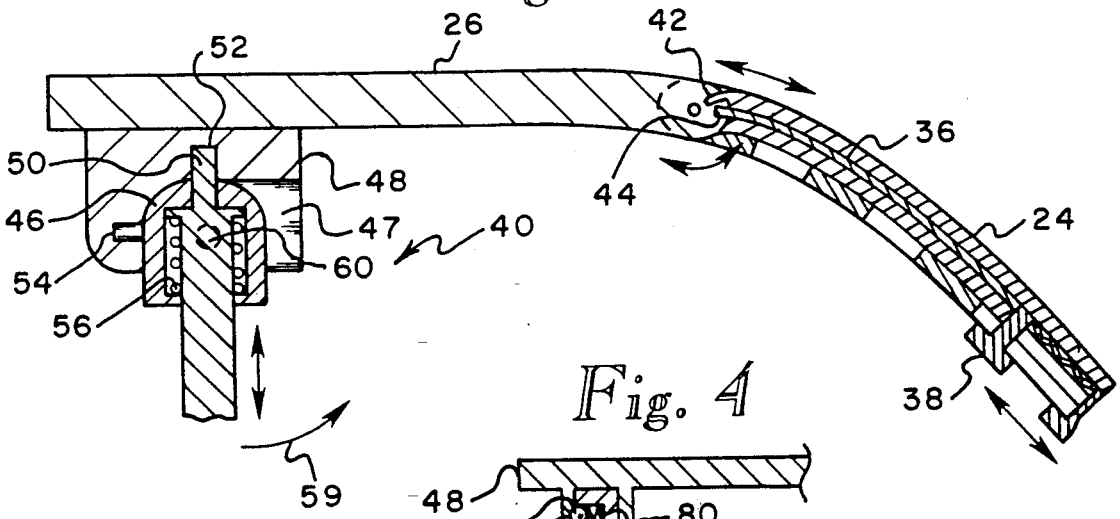
FIG. 3 is a more detailed view of a fragment of the frame and heel of FIG. 2.

FIG. 3 is a cross sectional view of a fragment of the shoe of FIG. 2. A means for adjusting the relative position of the arch section 24 to the heel section 26 is shown in more detail, as is means for stowing the heel 40.

As can be seen in FIG. 3, the movable bar 36 is maintained within the arch portion 24. At the heel portion 26, two bar receiving openings 42 and 44 are provided to act as stops or locks for the movable bar 36 in two positions, depending on whether the heel 40 is stowed or extended. The wearer pushes the slidable switch 38, which protrudes to the underside of the finished shoe, withdrawing the movable bar 36 from one of the bar receiving openings 42, 44, and allowing relative movement between the arch portion 24 and the heel portion 26 of the shoe frame 20, depending upon whether the heel is in the extended or stowed position. This provides a change in the angle of attachment of the arch portion 24 to the heel portion 26 of the shoe frame 20, and provides added comfort to the wearer. After the change is made, the slidable switch 38 springs back to its original position, inserting the movable bar 36 in the other bar receiving opening 42, 44, locking the movable bar 36 in its new position. The same procedure is performed to provide relative movement between the arch portion 24 and the toe portion 22 of my shoe frame, except in the opposite direction.

Although the above illustration shows two positions for the movable bar 36, additional bar openings can be provided, if desired, as will be readily understood by those skilled in the art, to provide additional flexibility to my shoe frame.

Referring now to the heel section of the shoe frame shown in FIG. 3, means for extending or stowing the transformable heel 40 is shown. The heel 40 is inserted into a rotatable joint 46 which can rotate within a corresponding hollow chamber 47 of a permanently affixed upper heel section 48 of the heel 40. The heel 40 culminates in a heel pin 50 which can be inserted in either of two pin receiving holes 52 and 54. A spring 56 urges the heel pin 50 into either of the pin receiving holes 52 and 54 respectively. When the wearer retracts the spring by pulling down the lower section of the heel 40, the heel pin 50 is retracted from the pin receiving hole 52, allowing the heel to rotate within the hollow chamber 47 in the direction of the arrow 59. When the heel has been pivoted to its stowed position, the wearer releases the heel pin 50 whereupon the pin portion 50 is urged into pin hole 54, locking the heel 40 in its stowed position. This process is reversed to convert to the high heel position. A pin 60, shown in dashed lines, is inserted horizontally through the upper heel section 48 and the heel 40 to prevent the heel 40 from being pulled out of the upper heel section 48.

The permanent upper heel section 48 comprises the low heel of the shoe frame 10 or 20. Its position relative to the end of the heel portion 14, 26 of the shoe sole 11 or 21 can be varied somewhat, depending on its final shape and height. It can be separately covered from the stowable lower heel section 58, and it can terminate in a covering of rubber or other known material that will improve wear.

FIG. 3A illustrates the heel 40 when the heel pin 50 is in a retracted position, preparatory to stowing the heel 40 in the direction of the arrow 59.

The heel 40 is shown as a steel post which is meant to be covered by various materials as explained above, thus providing great flexibility in the shape and design and height of the heel to be stowed, while imparting great strength to the heel. Other suitable materials however will suggest themselves to one skilled in the art.

FIG. 3B is a perspective view of the shoe frame of FIG. 2 illustrating the above-described means of adjusting the relative angle of the toe portion 22 to the arch portion 26. The movable bars 36 are fitted into the bar receiving openings 42, 44 depending on the angle between the several portions of the shoe frame. A plurality of support slats 62 are attached, as by welding, to the outside frame 64 of the arch portion 36.

The number of bars and slats can be varied depending on the overall shape of the final shoe and the relative heights of the heel in its high heel and low heel configurations.

Figure 4:
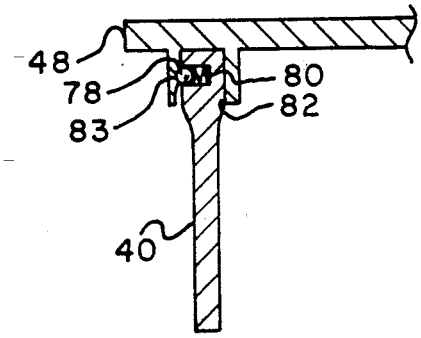
FIG. 4 is a side view of an alternate heel section illustrating a detachable heel.
Figure 4A:
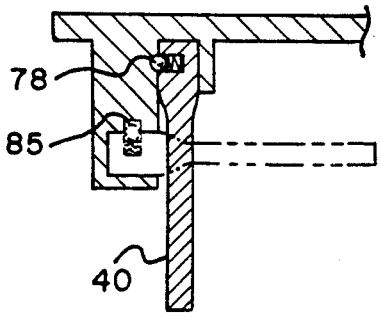
FIG. 4A is a side view of the heel of FIG. 4 illustrating the heel in an alternative stowed position.

Another method and apparatus for transforming the heel is shown in FIGS. 4 and 4A. The transformable heel section 40 is fitted with a ball bearing 78 and a spring therefor 80. The upper heel section 48 is fitted with an opening 82 for insertion of the heel section 40, a portion of which is hollowed out to form a receptacle 83 for reception of the ball bearing 78. For the embodiment shown in FIG. 4, with the heel in a high heel position, the heel section 40 is pushed into the opening 82 until the ball bearing 78 snaps into the receptacle 83. To detach the heel section 40, a downward pull on the heel 40 compresses the spring 80 and allows the heel 40 to be disengaged from the upper heel section 48. The heel section 40 can be separately stored.

As an alternate embodiment, the heel 40 can also be stowed beneath the shoe. As shown in FIG. 4A, a second receptacle 85 for the ball bearing 78 is built into the front of the upper heel section 48. The heel 40 can be rotated and snapped into the stowed position as shown by dashed lines in FIG. 4A.

Figure 5:
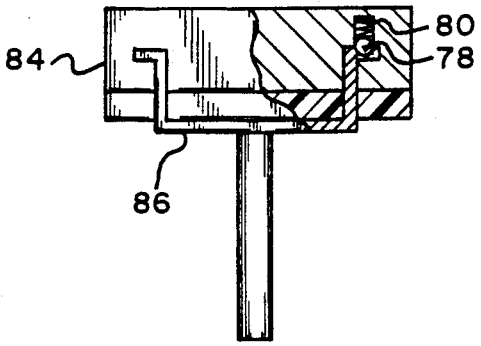
FIG. 5 is a front view of another embodiment of a detachable lower heel.
Figure 5A:
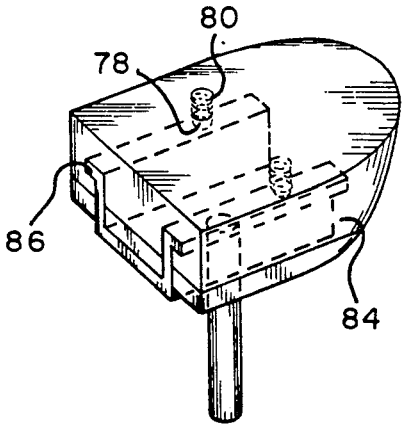
FIG. 5A is a perspective view of the upper and lower heel attached to each other.

Still another embodiment is shown in FIGS. 5 and 5A which illustrates a detachable lower heel section 84. FIG. 5 is a front view of a detachable lower heel 84. This lower heel section 84 is fitted with a shaped face plate 86 and a ball bearing 78 and ball bearing spring 80. This heel can be slidably removed from the upper heel section (not shown). The upper heel section is fitted with a groove (not shown) corresponding to the face plate 86. To remove the lower heel section 84, the lower heel section 40 is slid forward, disengaging the ball bearing 78 and the heel is slidably removed from the upper heel section. The lower heel 40 can now be stored separately from the shoe. To reinsert the detachable heel section 84, the face plate is fitted into the groove in the upper heel section until the spring 80 forces the ball bearing 78 into position within the upper heel section.

Figure 6:
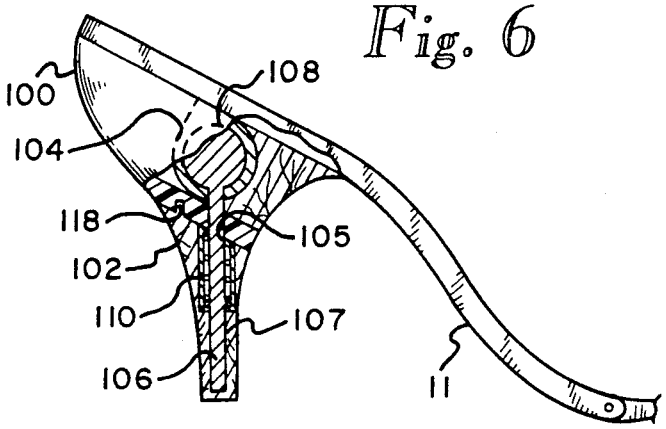
FIG. 6 is a cross sectional view of another embodiment of a stowable heel of the invention illustrating an extended heel.

FIG. 6 illustrates an alternate method of stowing a heel in accordance with the invention.

The heel of FIG. 6 is also in two sections; an upper, permanently affixed heel section 100 and a lower heel section 102. The upper heel section 100 is fitted with a hollowed, generally curved housing 104 and a slot 105 through the bottom of the heel. The lower heel section 102 has a post 106 inserted into a central opening 107 defining a substantially central axis of said lower heel section, said post 106 having a generally wheel-like top 108. The post 106 passes through the slot 105 while the wheel-like top 108 is contained in the housing 104 wherein the wheel can rotate, allowing for both vertical and horizontal movement of the post 106 through the slot 105. The post 106 is fitted with a spring 110 that generally urges the post 106 and the lower heel section 102 toward the upper heel section 100.

Figure 6B:
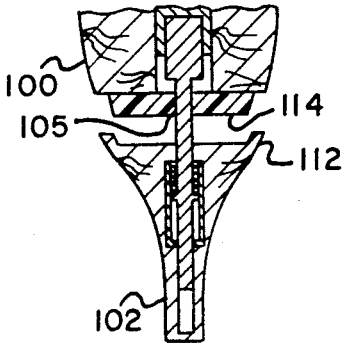
FIG. 6B is a rear view of the heel of FIG. 6.
Figure 6A:
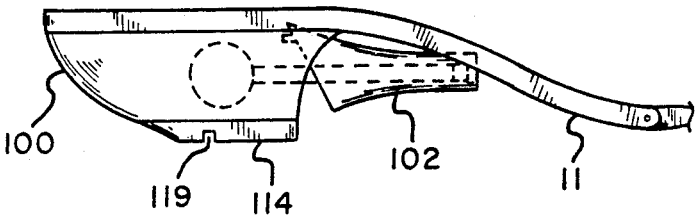
FIG. 6A is a cross sectional view of the heel of FIG. 6 illustrating a stowed position of the heel.

The lower heel section 102 is stowed by exerting a downward pull to separate the lower heel section 102 from the upper heel section 100, rotating the lower heel, section 102 by 180 degrees about its central axis and pivoting it forward to a stowed position, as shown by means of dashed lines in FIG. 6A. The spring 110 will maintain the new alignment of the lower heel section 102, drawing the lower heel section 102 partway into a storage space in the forward aspect of the upper heel section 100 and the sole 11, 21.

FIG. 6B is a rear view of the heel of FIG. 6 showing a further embodiment of a stowable heel. The lower heel section 102 has a beveled edge 112 that, when the heel is in the high heel position, extends over the lower edge 114 of the upper heel section 100, which is shaped so that when both heel sections are urged together, a snug fit is achieved. This ensures against rotation of the heel in its high heel position.

This embodiment also has the advantage that any wear or damage to the end of the upper heel 100 caused by walking on it will be hidden from view by the beveled edge 112 of the lower heel section 102 when it is in the extended position. If desired, a locking pin 118 may be attached to the upper edge 116 of the lower heel 102. An opening 119 for reception of the locking pin 118 is provided in the bottom 114 of the upper heel 100 to ensure against any rotation of the lower heel 102 with respect to the upper heel 100.

This heel has a further advantage in that the heel in its stowed position is stowed so that the outside rear face of the lower heel section 102 is turned so that it rests in its stowed position against the lower sole of the shoe, protecting it from damage and dirt caused by the wearer walking on uneven or wet terrain and the like. To return to the high heel position, the heel is pulled outwardly and rotated 180 degrees on its long axis and swung back to the vertical position where it springs upwardly to ensure a snug fit of the upper beveled edge 112 and the bottom of the upper heel section 114.

Figure 7:
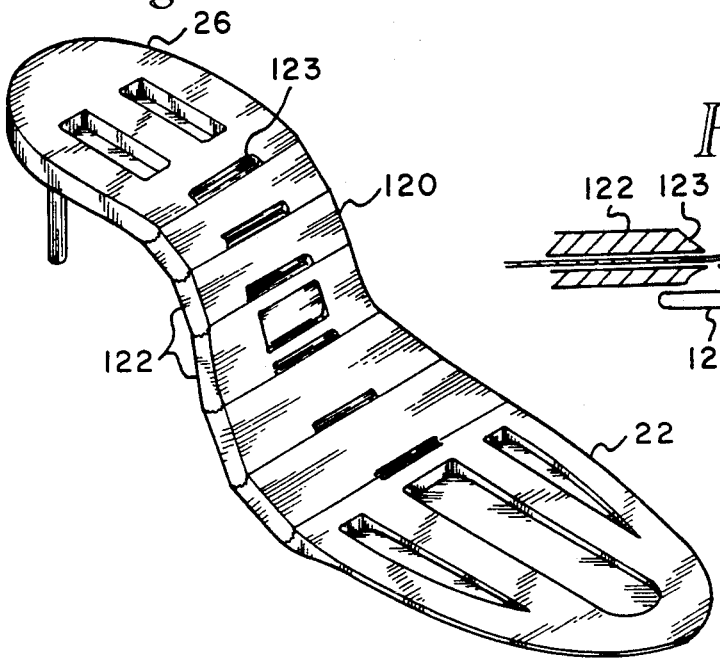
FIG. 7 is a perspective view of an alternate shoe frame of the invention having an adjustable arch.
Figure 7A:
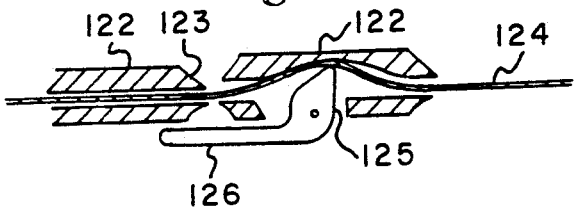
FIG. 7A is a cross sectional view of a portion of the arch of FIG. 7 illustrating a band of the arch in tension.
Figure 7B:
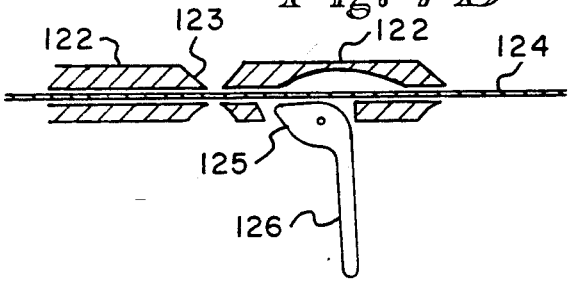
FIG. 7B is a cross sectional view of a portion of the arch of FIG. 7 illustrating a band of the arch in release.
Figure 7C:
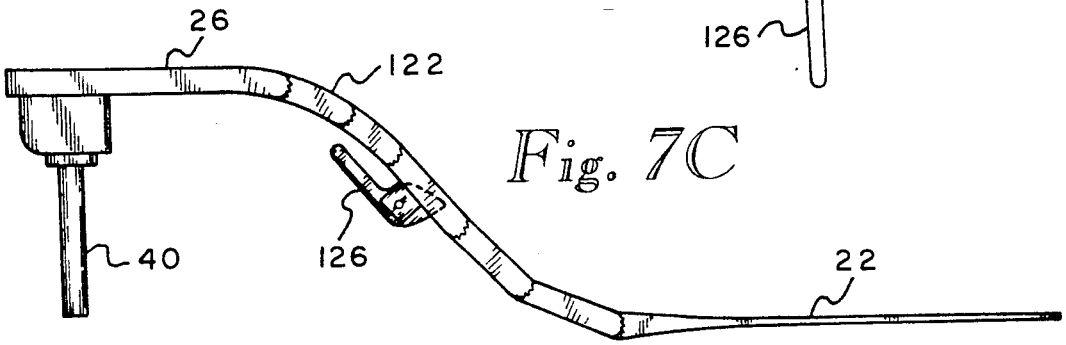
FIGS. 7C and 7D are cross sectional views of the embodiment of FIG. 7 illustrating the heel in an extended and stowed position respectively.

An alternate embodiment of my shoe frame is shown in FIG. 7 wherein a rigid arch portion 24 of my shoe frame is replaced by an adjustable arch portion 120. The flexible arch portion 120 is comprised of a plurality of slats 122 held rather tightly together. The slats 122 are supported by one or more steel bands 124, as seen in FIGS. 7A and 7B. The edges 123 of the slats 122 can be frictionally engaged, as by making their edges of a material such as rubber and the like; or the edges 123 of the slats 122 can be grooved so that they can pivot with respect to each other. A cam 125 abuts the steel band 124 and the cam 125 is turned by a lever 126, as shown in FIGS. 7A, 7B and 7C. The lever 126 increases and decreases the tension on the steel band 124. The slats 122 can be adjusted when the tension on the band 124 is released, as seen in FIG. 7B. When the tension on the steel band 124 is reapplied by closing the lever 126, as seen in FIG. 7A, the tension on the steel band 124 is increased and the slats 122 are again fitted together in a new fixed relationship. Each of the slats 122 can rotate with respect to each other in only a limited amount in any direction. By grooving or shaping other areas of articulation between the slats 122 appropriately, the range of motion of the slats 122 can be preprogrammed into the design of each joint. This will guide the end user into said one or another of two extremes of position when reshaping the arch for high heel or low heel wear. Shoes designed for different styles and heel heights will have different ranges of motion preprogrammed into the articulation between the slats 122.

Figure 7D:
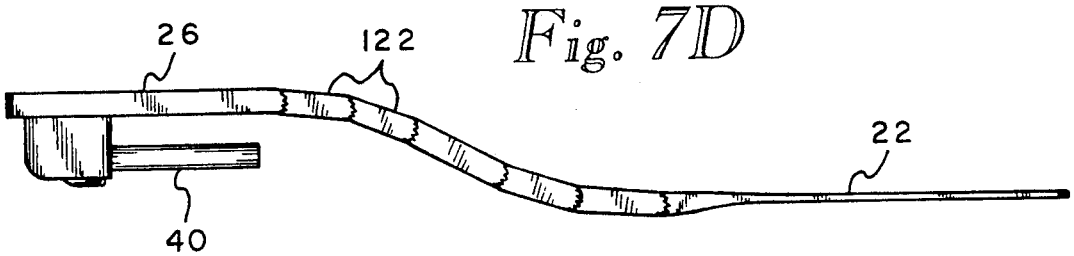

FIGS. 7C and 7D illustrate a different contour of the arch portion 120 when the heel is extended (FIG. 7C) or stowed (FIG. 7D) using the means of the embodiment of FIG. 7.

Figure 8:
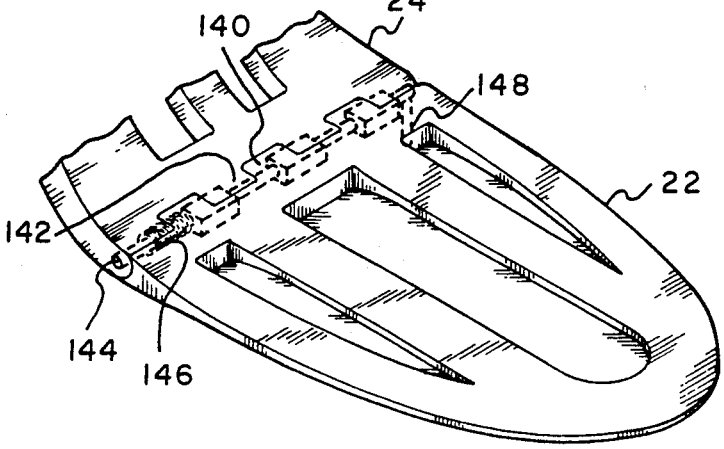
FIG. 8 is a fragmentary perspective view of an alternate means of locking two portions of my shoe frame together.

FIG. 8 illustrates an alternate embodiment of a locking mechanism to allow pivotal movement between the sole sections of my shoe frame. By way of example, FIG. 8 shows a hinged articulation between the toe portion 22 and the arch portion 24 whose hinge tongues have various cross-sectionally shaped holes to receive a hinge pin. For example, the hinge tongues 140 on the arch section 24 have openings 141 with a square cross section, see FIG. 8A, while the opposing toe hinge tongues 142 have openings 143 with eight point star cross sections, see FIG. 8B. A hinge pin 144 has an alternating cross sectional profile, square 150 and circular 152. The hinge pin 144 can slide within the hinge pin openings 141, 143 and a spring 146 moves the pin into its resting position. In this position, shown in FIG. 8C, the square segments 150 of the hinge pin 144 bridge opposing hinge tongues 140, 142, locking in their relative position. To unlock the joint, a switch (not shown) attached to a tab 148, which is attached to the hinge pin 144, will slide the hinge pin 144 to a new position when the switch is moved, shown in FIG. 8D. In this way, the hinge pin can be moved so that the square segments are completely within the hinge tongues 140 of the arch section. The round segments of the hinge pin 144 are now completely within the tongues 142 of the toe section. The joint is unlocked and can be pivoted to a new position. When released, the hinge pin 144 will spring into place to lock in the new position. Thus the hinge pin 144 serves as the locking mechanism for the hinge articulation. The exact location of the tab 148 is illustrative only and can be changed for the convenience of the shoe designer.

Figure 8A:
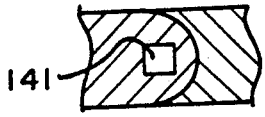
FIGS. 8A and 8B are cross sectional views of the locking mechanism of FIG. 8 with the hinge pin removed and locked in one of two possible positions, respectively.
Figure 8B:
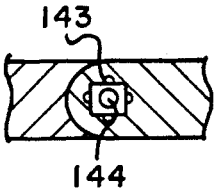

FIGS. 8A and 8B are cross sectional views of the interior of the hinges. FIG. 8A illustrates a square opening 141 empty. FIG. 8B illustrates an 8 point star cross section of the opening with the hinge pin 144 locked in place.

Although the embodiment of FIGS. 8, 8A and 8B has been exemplified in shapes that are circular and square, other shapes can be used, e.g., the squares can be replaced by other cross sectional shapes such as stars, polygon, gear teeth and the like, as desired.

Figure 8C:
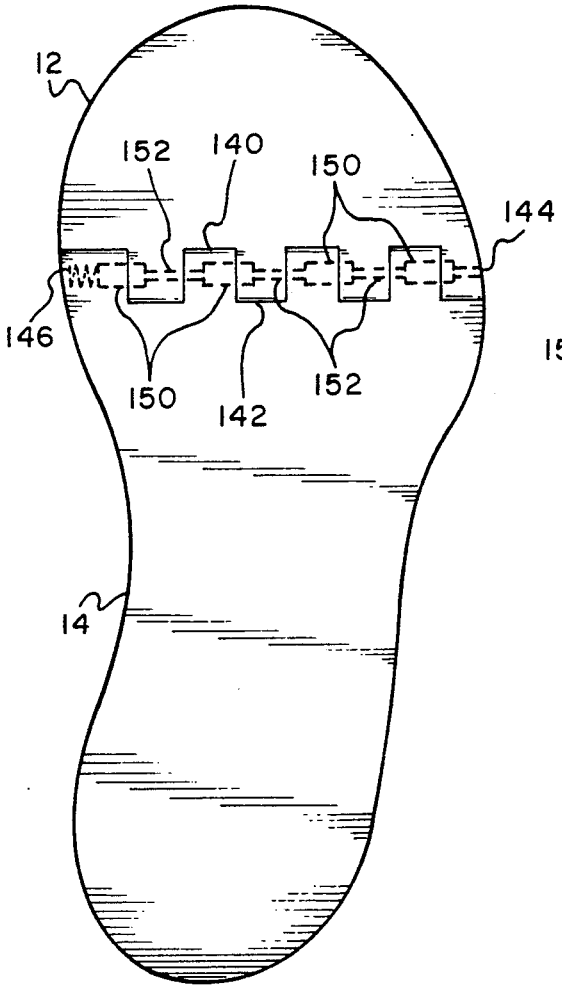
FIGS. 8C and 8D are top views of the adjustable shoe of FIG. 8 with the locking mechanism in their locked and unlocked positions respectively.
Figure 8D:
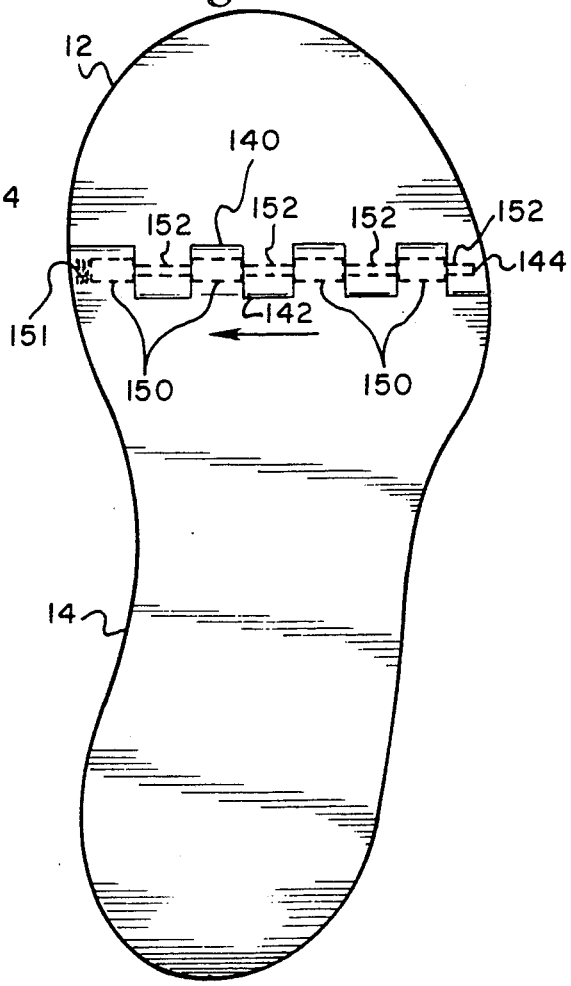

FIGS. 8C and 8D are top views of the shoe frame 10 illustrating the hinge pin 144 in its locked and unlocked positions respectively.

FIG. 8C illustrates the hinge pin 144 in its resting position. The square segments 150 bridge opposing hinge tongues, locking the joint. In FIG. 8D, the hinge pin 144 has been slid sidewise, compressing a spring 151 which otherwise keeps it in its resting and locked position. The square segments 150 of the hinge pin 144 are now completely contained within the hinge tongues 140 of the arch section. The opposing hinge tongues 142 of the toe section can now pivot on the circular segments 152 of the hinge pin 144, allowing the joint to be repositioned and relocked in a new position.

Figure 9:
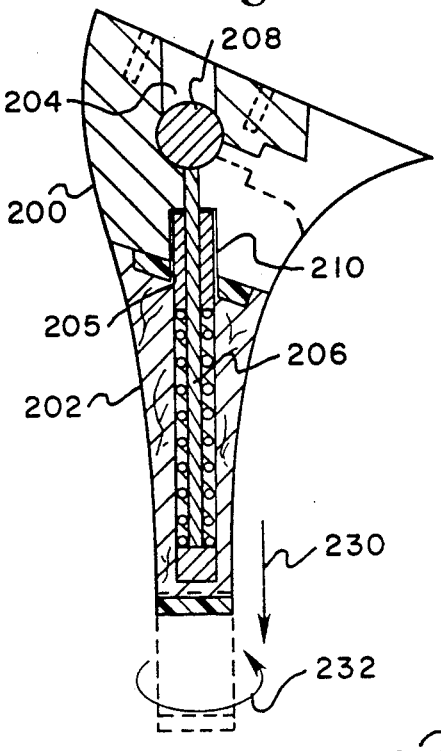
FIG. 9 is a cross sectional view of another embodiment of a stowable heel of the invention illustrating an extended heel.
Figure 9B:
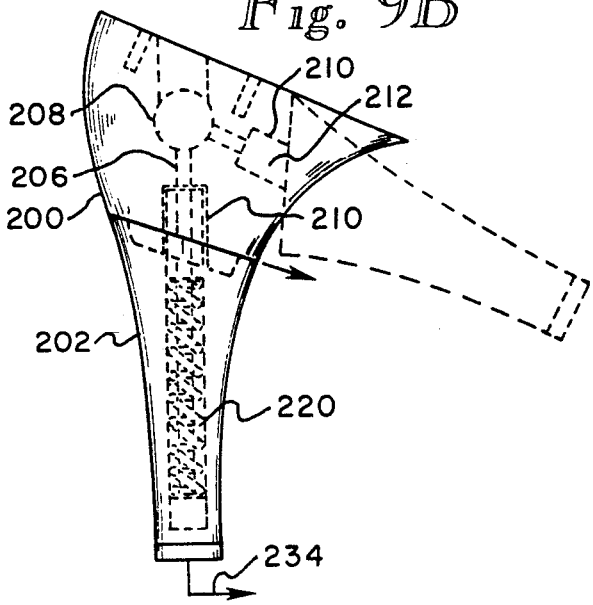
FIG. 9B is a cross sectional view of the heel of FIG. 9 showing in dashed lines the alternate positions of the heel in its extended and stowed positions respectively.
Figure 9A:
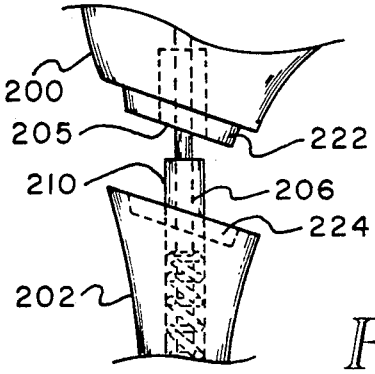
FIG. 9A is an exploded view of the heel of FIG. 9 in an extended position prior to stowing the lower heel.

FIG. 9 is a cross sectional view of an alternate stowable heel of the invention having an improved locking mechanism. The heel of FIG. 9 is also in two sections; an upper permanently affixed heel 200 and a lower heel section 202. The upper heel section 200 is fitted with a hollowed, generally curved housing 204 and a slot 205 through the bottom of the upper heel section 200. The lower heel section 202 has a post 206 having a generally round top 208 for reception into the housing 204. The post 206 is surrounded by an outer extension 210 of the lower heel section 202 that is irregularly shaped, as, for example, a round shape with a flattened side facing forward. The slot 205 has a corresponding shape to the post top 208 that fits snugly to the extension 210. The round top 208 can rotate within the housing 204, allowing for both vertical and horizontal movement of the post 206 within the housing 204. A spring 220 surrounding the post 206 generally urges the lower heel section 202 toward the upper heel section 200. Further, the extension 210, when fitted into the slot 205 so that the two heel sections 200,202 fit together, locks the lower heel 202 in fixed relationship with the upper heel section 200 so that little or no forward movement of the lower heel 202 can take place in the extended heel position, as shown in FIG. 9A, which is an exploded rear view of the heel 200, 202. This feature provides added stability to the heel so that the lower heel section 202 cannot be pushed forward when pressure is exerted on it, as by walking. FIG. 9A also shows an upper heel extension 222 and a corresponding opening 224, shown in dashed lines, providing a snug fit of the two heel section 200, 202. This configuration of the lower heel also provides an outer covering of the heel extension 222 so that any scratches, wear marks and the like imparted to the heel when walking on the upper heel section 200 and extension 222, e.g., when the lower heel 202 is in a stowed position, are covered over when the heel is in its extended position.

The lower heel 202 is stowed by pulling down in the direction of the arrow 230 shown in FIG. 9, thereby disengaging the upper heel section 200 from the lower heel section 202, as shown in FIG. 9A, compressing the spring 220 and withdrawing the heel extension 210 from the slot 205. The lower heel section 202 is then rotated about 180 degrees in the direction of the arrow 232. FIG. 9B illustrates in dashed lines the relative positions of the extension 210 in the extended and stowed positions of the lower heel 202.

FIG. 9B is a side view of the heel 200, 202 showing in dashed lines the position of the heel extension 210 in the extended and stowed positions. To stow the heel, the lower heel 202 is pulled down in the direction of the arrow 230, then rotated on post 206 by 180 degrees in the direction of the arrow 232, and then swung forward in the direction of the arrow 234. An opening 212, shown in dashed lines in the front of the upper heel section 200 corresponds to the slot 205 and allows the heel extension 210 to be locked into the stowed position.

Figure 9C:
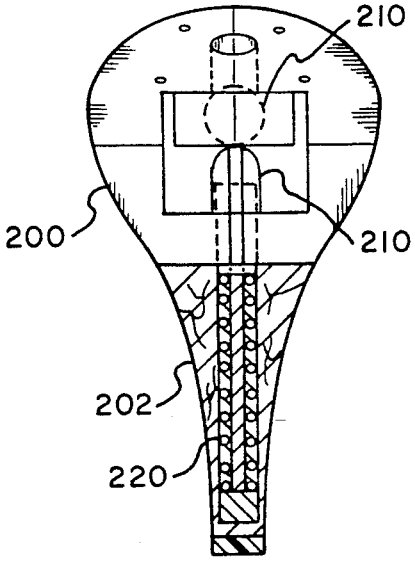
FIG. 9C is a rear view of the heel of FIG. 9.

FIG. 9C is a cross sectional view of the back of the heel 200, 202 showing in dashed lines the position of the extension 210 when the lower heel section 202 is in the stowed position.

Figure 10:
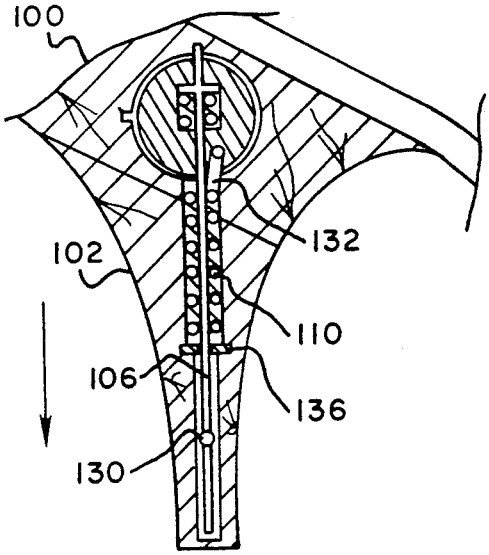
FIG. 10 is a cross sectional view of still another embodiment of a stowable heel of the invention showing an extended heel.

FIG. 10 is an alternate embodiment of the heel of FIG. 6 showing additional features that can optionally be incorporated into my stowable heel. The numbers for like parts correspond to the numbers given in FIG. 6 which have like parts.

FIG. 10 illustrates a two part heel 100, 102 wherein the lower heel 102 has a stop 130 for the post 106 which limits how far the lower heel 102 may be pulled away from the upper heel 100. Further, this embodiment has a stiff spring 132 attached to the spring 110 that also limits the movement of the spring 110. A washer 136 embedded in the lower heel 102 and rotatable with the lower heel 102, is attached to the post 106. The washer 136 rotates when the lower heel 10 is rotated for stowing. This avoids rotating the spring 110 when the lower heel 102 is rotated. A stop 138 is at the bottom of the post 106 and prevents the post 106 from being pulled entirely out of the upper heel 100.

Figure 10B:
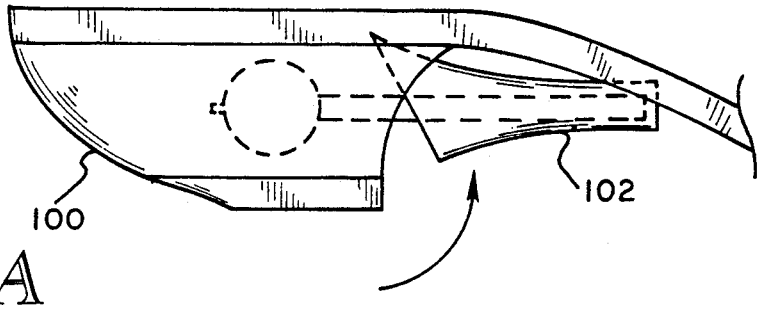
FIG. 10B is a cross sectional view of the heel of FIG. 10 in its stowed position.
Figure 10A:
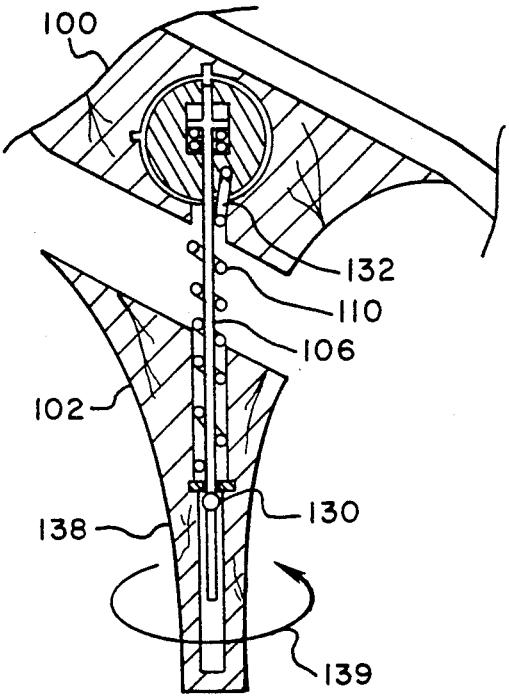
FIG. 10A is an exploded side view of the heel of FIG. 10 in an extended position prior to stowing the lower heel.

FIG. 10A is an exploded side view of the heel of FIG. 10 in an extended position prior to stowing the lower heel 102. The heel 102 is rotated in the direction of arrow 139.

FIG. 10B is a side view of the upper heel 100 and the stowed lower heel 102 (in dashed lines) in its stowed position.

Figure 11:
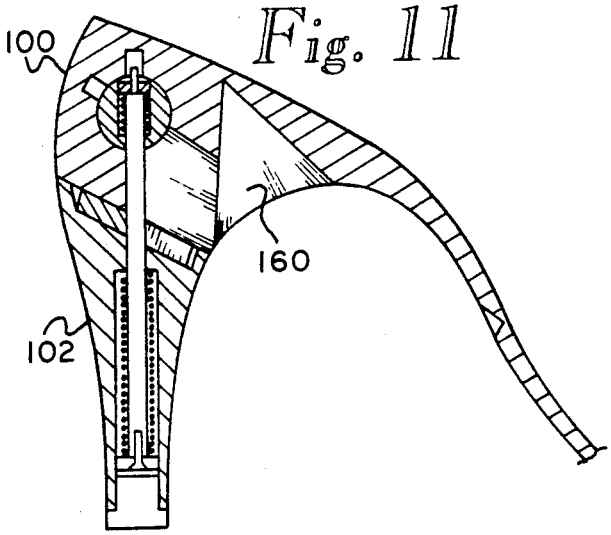
FIG. 11 is a cross sectional view of another embodiment of a stowable heel of the invention showing an extended heel.
Figure 11A:
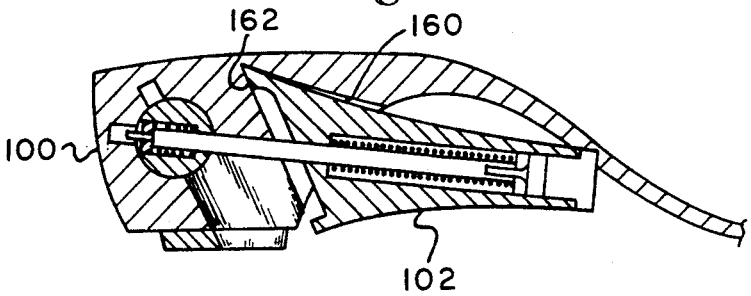
FIG. 11A is a cross sectional view of the heel of FIG. 11 in its stowed position.

FIG. 11 shows still other embodiments of my stowable heel. This version is also a two part heel wherein the heel has an opening 160 in the upper heel 100 for insertion of the top of the lower heel 102 in its stowed position. In the stowed position as shown in FIG. 11A, the top edge 162 of the lower heel is inserted into the opening 160 which protects the upper heel from damage when walking on the upper heel 100.

Thus the transformable shoe sole of the invention can be made of a single sole piece, or additional pieces as described hereinabove. Generally a one or two piece sole will be utilized, and can be made of an injection molded polymer or other synthetic material. A two piece sole will have a hinge type joint in the metatarsal region. This hinge joint may have a built-in defined range of motion. Its contacting surfaces may be texturized for example to cause some limited restriction to flexion and extension, and also to act as a shock absorber.

A one piece sole can be employed that will have some flexibility in the distal metatarsal region. This can be achieved by choice of material, or by scoring or otherwise thinning the sole in the metatarsal region. When a sole reinforcement is used, which is conventional for high heel shoes, the reinforcement, which can be a steel shank for example, will be placed outside of the area of the sole having maximum flexion, such as a hinge joint or other mode. For example, the reinforcement will be placed at the back of the sole adjacent to the heel portion of the shoe.

Other ways of adjusting the angle of the individual portions of the shoe sole will suggest themselves to one skilled in the art, and are meant to be included herein.

It is apparent that the shoe designer has a wide choice among the various embodiments shown herein of both the shoe sole elements and the heel elements, depending on the ultimate design of the shoe, and the relative heights of the high heel and the low heel versions. The shoe frame and heel as described hereinabove are not meant to be limited to the details described herein, but many variations thereof will be apparent to one skilled in the art. For example, the shoe frame can be made of additional portions so as to allow for greater variation of the contour of the sole and the relative positions of the arch with respect to the heel and toe portions of the shoe, thereby providing for a wide variation in design. The relative positions of the sole portions can be adjusted to allow for variations in the height and shape of the extended heel to be employed. Thus the invention is meant only to be limited by the appended claims.

I claim:

1. In a shoe having a sole with a toe portion, a heel portion and an arch portion located between said heel and toe portions, the improvement comprised of a stowable heel comprising:

a) an upper heel section attached to the heel portion of said shoe sole;

b) a lower heel section attached to said upper heel section, said lower heel section having a central axis, and c) means for rotating said lower heel section about its central axis and for pivoting the same relative to said sole so that said lower heel section can be moved between a first position wherein it underlies and is in substantial alignment with said upper heel section and a second position wherein it lies substantially beneath said arch portion of said sole.

2. The invention according to claim 1 wherein said pivoting means comprises a retractable pin attached to said lower heel section and protruding therefrom and a chamber having two openings for reception of said retractable pin corresponding to two different positions of the lower heel section with respect to the upper heel section.

3. The invention according to claim 2 wherein said upper heel section has an opening in its upper front face for reception therein of said pivoted lower heel.

4. The invention according to claim 2 wherein said lower heel is fitted with a stop to limit the distance the lower heel can be pulled away from the upper heel.

5. The invention according to claim 1 wherein an opening in the front of said upper heel is adapted to receive a portion of said lower heel in its stored position.

6. The invention according to claim 1 wherein said pivoting means comprises a post extension having a round top with a flat side extending from said lower heel section and a corresponding opening in said upper heel section for reception of said post extension, whereby when said post extension is fitted into said opening in said upper heel section, improved stability is imparted to said extended heel.

7. The invention according to claim 1 wherein said pivoting means comprises a post extension having a non-circular top extending from said lower heel section and a corresponding opening in said upper heel section for reception of said post extension, whereby when said post extension is fitted into said opening in said upper heel section, improved stability is imparted to said extended heel.

8. The invention according to claim 1 wherein said upper heel section has a chamber for the reception of a post affixed to said lower heel section having a wheel-like head, such that said post can rotate about 180 degrees within said chamber and pivot the lower heel section under the sole of a shoe.

9. The invention according to claim 8 wherein said lower heel is fitted with a stop to limit the distance the lower heel can be pulled away from the upper heel.

10. The invention according to claim 8 wherein a washer embedded in said lower heel is attached to said post and is rotatable with said lower heel.

11. The invention according to claim 8 wherein an opening in the front of said upper heel is adapted to receive a portion of said lower heel in its stowed position.

12. A heel according to claim 1 wherein said lower heel section has a beveled edge that fits over the bottom of said upper heel section.

13. The invention according to claim 12 wherein said lower heel section has a locking pin protruding from its upper surface and said upper heel section has an opening in its bottom surface for reception therein of said locking pin.

* * * * *